United States Patent [19]

Würthner et al.

[11] Patent Number: 5,042,830

[45] Date of Patent: Aug. 27, 1991

[54] SOLE-SUPPORT PLATE FOR SKI BINDINGS

[75] Inventors: Hubert Würthner, Hainburg/Donau; Johann Zotter, Vienna; Roland Erdei, Weigelsdorf; Helmut Wladar, Vienna, all of Austria

[73] Assignee: TMC Corporation, Baar, Switzerland

[21] Appl. No.: 466,351

[22] PCT Filed: Jun. 15, 1989

[86] PCT No.: PCT/EP89/00674

§ 371 Date: Mar. 2, 1990

§ 102(e) Date: Mar. 2, 1990

[87] PCT Pub. No.: WO90/00426

PCT Pub. Date: Jan. 25, 1990

[30] Foreign Application Priority Data

Jul. 8, 1988 [AT] Austria ..... 1770/88

[51] Int. Cl.[5] ..... A63C 9/00

[52] U.S. Cl. ..... 280/636; 280/611

[58] Field of Search ..... 280/611, 612, 607, 636, 280/633, 634, 623, 616, 617, 618

[56] References Cited

U.S. PATENT DOCUMENTS

| | | | |
|---|---|---|---|
| 3,977,688 | 8/1976 | Imagawa | 280/633 |
| 4,268,062 | 5/1981 | Wittmann | 280/611 |
| 4,522,422 | 6/1985 | Jaeger | 280/633 |

FOREIGN PATENT DOCUMENTS

| | | | |
|---|---|---|---|
| 361824 | 4/1981 | Austria | 280/634 |
| 2102757 | 7/1971 | Fed. Rep. of Germany | 280/633 |
| 2363562 | 7/1974 | Fed. Rep. of Germany . | |
| 2613387 | 10/1977 | Fed. Rep. of Germany . | |

*Primary Examiner*—David M. Mitchell

*Attorney, Agent, or Firm*—Flynn, Thiel, Boutell & Tanis

[57] ABSTRACT

A sole-support plate for ski bindings which can be mounted on a base plate of a ski-binding part. The base plate is held onto the upper side of a ski by means of fastening screws, and is held against a lifting off in its mounted state and is also secured against a movement relative to the ski by means of a locking system. A block is formed by the fastening screw and engages a detent formed in a recess in the sole-support plate to prevent the aforesaid relative movement.

9 Claims, 2 Drawing Sheets

SOLE-SUPPORT PLATE FOR SKI BINDINGS

FIELD OF THE INVENTION

The invention relates to a sole-support plate for ski bindings.

BACKGROUND OF THE INVENTION

A sole-support plate of this type is perhaps described, for example, in Austrian Patent No. 356 561 (corresponding to U.S. Pat. No. 4,268,062). The sole-support plate is thereby held against an unintended lifting off in its mounted state in the form of a spring/groove guide on the base plate of the ski-binding part by means of its two lateral extensions. To lock the sole-support plate on the ski-binding part against a movement in longitudinal direction of the ski, of course further structural parts, as for example, a detent cooperating with a locking recess on the other structural part of the ski binding, are needed.

A further development of this known solution according to Austrian Patent No. 363 020 (corresponding to U.S. Pat. No. 4,268,062) also does not overcome this disadvantage.

Austrian Patent No. 361 824 discloses an adjusting plate, which will be removed after the ski binding has been screwed on tightly. The extensions of the adjusting plate, which extensions are used to receive the screws, are for this purpose provided with fork prongs, which are broken off by the force occurring during tightening of the screws (compare Page 5, lines 17 to 25). Thus the extensions disclosed in this reference cannot be compared to the keyhole-like recesses used in the invention to constantly hold the sole-support plate on the fastening screws. They also do not suggest the solution of the invention.

Devices with keyhole-like constructed recesses on the upper side of the ski or on mounting plates for receiving locking elements provided on ski-binding parts are known from German OS Nos. 23 63 562 and 26 13 387. Of course, these keyhole-like recesses are designed with a closed contour since the locking elements of the binding members are guided exclusively from above into the recesses. A keyhole-like recess with a free straight section, as this is disclosed in the closest state of the art according to Austrian Patent No. 356 561 and has already been considered above, is not disclosed in these two references.

SUMMARY OF THE INVENTION

The purpose of the invention is to provide a sole-support plate of the above-mentioned type such that, aside from the fastening screws needed for fixing the ski-binding part on a ski, no further structural parts are needed for mounting the sole-support plate.

Since according to the invention, the fastening screw acts as a block engageable with a detent in a recess in the sole-support plate, which recess is shaped like a keyhole and opening frontwardly in its straight section to serve as a matching notch, a separate locking mechanism is not needed. Due to the fact that the sole-support plate has at its area facing the ski-binding part the keyhole-like recess, the centerline of which is in alignment with the centerline of the fastening screw on the ski-binding part, the detent being formed by fastening screw itself, a mounting or demounting of the sole-support plate on the ski-binding part is easily possible.

In view of the forces occurring both outwardly and also inwardly in the horizontal plane on the ski-binding parts, it is advantageous to provide a pair of screws symmetrically on opposite sides of a center axis of the base plate.

Actually it would be possible to design the recesses in the sole-support plate, which recesses receive the screwheads, to be suitable for countersunk screws. However, it has been proven to be advantageous if these bores are receiving points with a clearance of approximately 0.5 mm for fillister-head screws. This simplifies the manufacturing process since no attention need be paid to tolerances on fit and still a connection safe from an unintended relative movement between the fillister-head screw and the recesses is guaranteed. A seal ring provided around each fastening screw creates a safe closure for preventing snow, ice and other undesired contaminants from penetrating into the bore holding the screw.

To be complete, it is mentioned that it has already become known in a device, according to Austrian Patent No. 361 824 used to fasten ski-binding parts on a base or stepping plate on a ski, to use forklike extensions for receiving of screws, which are then screwed into the ski. This known device, however, was designed as a one-way part and is used exclusively as a mounting aid.

BRIEF DESCRIPTION OF THE DRAWINGS

The invention will be described in greater detail in connection with the drawings, which illustrate one exemplary embodiment and in which.

DETAILED DESCRIPTION

Figure 1:
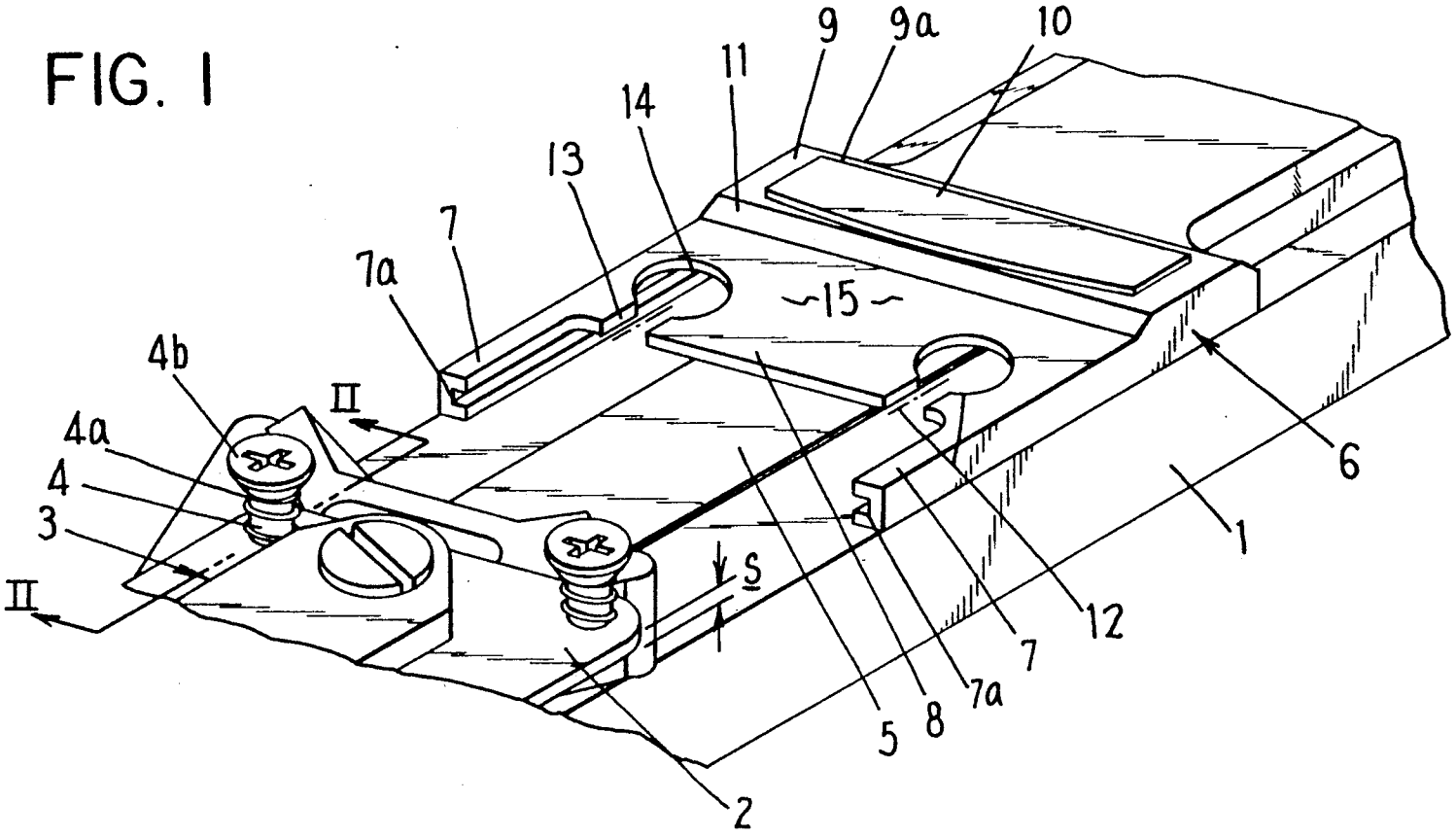
FIG. 1 is a perspective view of a sole-support plate of the invention.

The base plate 2 of a jaw member 3, which is only partially indicated, and which is used as a ski-binding part, is fixed on a ski 1, as shown in FIG. 1, by means of a pair of fastening screws, namely, fillister-head screws 4 with a conical tapering head. The screws 4 are already placed into the base plate 2 in a conventional manner; this embodiment is not part of the subject matter of the present invention. A metal band 5 is furthermore fastened to the base plate 2, which metal band carries a further jaw member here not illustrated. The measure to use in a ski binding a metal band to connect its two jaw members is known and also is not part of the subject matter of the present invention.

A sole-support plate 6, the design of which is an important feature of the invention and which will be described hereinafter, can be moved onto the base plate 2. Such a sole-support plate 6 is used to hold down the sole of a ski boot, with the sole-support plate 6 itself being designed such that it guarantees in a conventional manner an unhindered passage of the metal band 5 therethrough even when the ski 1 is bent.

As one can particularly take from FIG. 1, the sole-support plate 6 has extensions 7 extending in direction of the base plate 2 of the jaw member 3. A cross-piece 8 is constructed on the sole-support plate 6 between the two extensions 7, which cross-piece—referred to its longitudinal center axis—is offset rearwardly symmetrically and relative to the free end areas of the two extensions 7. The rearwardly extending sections of the extensions 7 are connected by means of a bridge section 9 which is elevated relative to the plane of the cross-piece 8 and having in a conventional manner a recessed receiving area 9*a* for the insertion of a guide plate 10 made of a low friction material, for example, of polytetrafluoroethylene. A sloped transition area 11 extends between the bridge section 9 and the cross-piece 8. Thus, it is guaranteed that a ski boot with its sole rests only on the guide plate 10 assuring a precalculated release operation.

A keyhole-like recess 12, with a free, straight section 13 and with an adjacent head section 14 designed as a bore, is provided between the individual extensions 7 and the cross-piece 8. Each free, straight section 13 of the individual recesses 12 is dimensioned such that the shaft 4*a* of the associated fillister-head screw 4 can move therethrough unhindered. Through the movement of the sole-support plate 6 onto the base plate 2, the individual shafts 4*a* of the two fillister-head screws 4 simultaneously guide the sole-support plate 6. The free, straight section 13 of each recess 12 is followed by a circular head section 14, which head section 14 is provided for receiving the head 4*b* of the associated pre-inserted fillister-head screw 4. In the mounted state of the sole-support plate 6 on the base plate 2 of the jaw member 3, the individual fillister-head screws 4 sit with their head 4*b* in the individual head sections 14 of the sole-support plate 6 and lock same against an unintended movement in longitudinal direction of the ski away from the base plate 2.

To lock the sole-support plate 6 against an unintended lifting off from the upper side of the ski 1, two extensions 7 each have a groove 7*a*, the height of which is dimensioned with play/normal clearance corresponding with the thickness s of the base plate 2 and the length of which guarantees a safe guiding of the sole-support plate 6 on the base plate 2. The depth of each groove 7*a* is dimensioned such that the sole-support plate 6 can be guided with play/normal clearance on the width of the base plate 2. The exact position of the sole-support plate 6 on the base plate 2 is determined in the mounted state by the two fillister-head screws 4.

Figure 2:
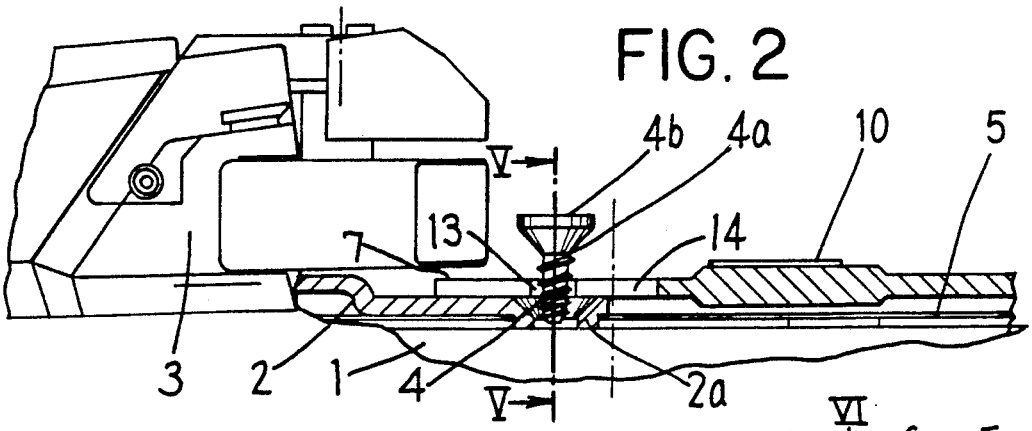
FIG. 2 is a longitudinal cross-sectional view taken along the line II—II of FIG. 1 with the sole-support plate being partially moved on, FIG. 3 is a longitudinal cross-sectional view similar to FIG. 2, however, in the position of use of the sole-support plate.
Figure 5:
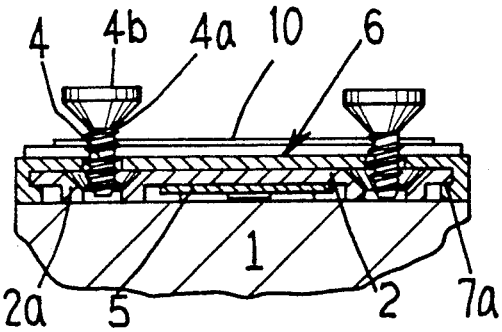
FIG. 5 is a cross-sectional view taken along the line V—V of FIG. 2.

If the sole-support plate 6 is now supposed to be moved into its operating position, it is moved on along the metal band 5 in direction of the base plate 2 of the jaw member 3. One position during this movement, namely, when the shafts 4*a* of the two fillister-head screws 4 are in the area of the free, straight sections 13 of the keyhole-like recesses 12, is shown in FIGS. 2 and 5. It can easily be recognized in these figures that both for the mounting and for the demounting the fillister-head screws 4 must not yet be completely screwed into or out of the bores in order to guarantee an unhindered moving on or moving off of the sole-support plate 6. This measure shows at the same time that for a possible exchange of the sole-support plate 6, the individual fillister-head screws 4 must only be loosened, however, must not be unscrewed from their bores. However, this has the result that, on the one hand, the receiving bores of the screws are not worn much and, on the other hand, the base plate 2 of the jaw member 3 remains always in its mounted position.

Figure 3:
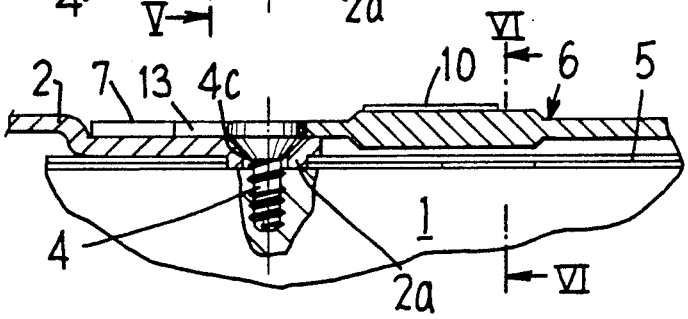
Figure 4:
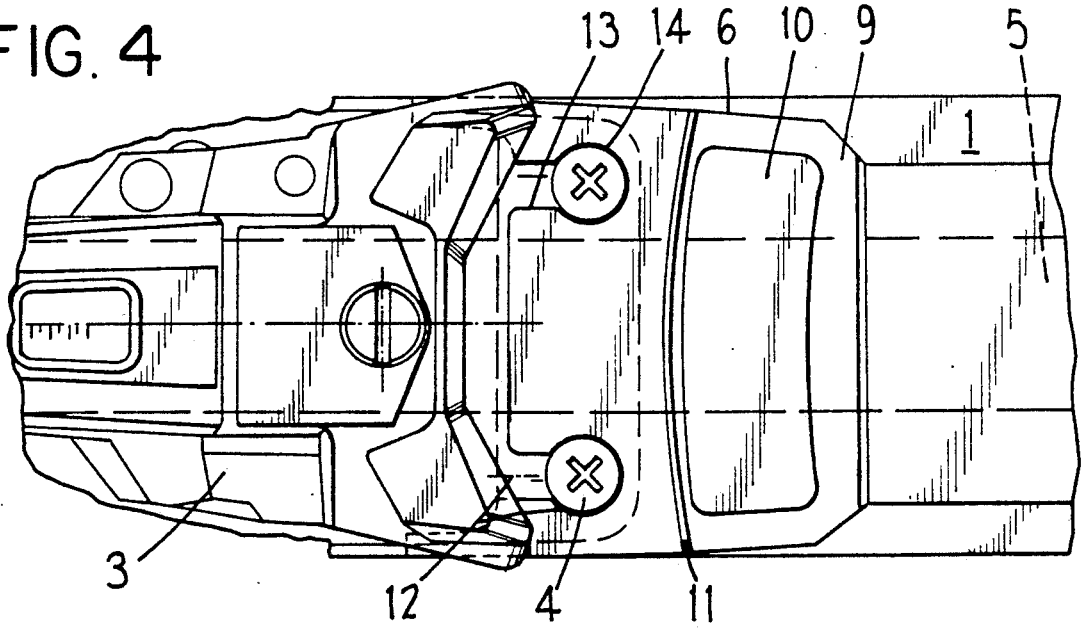
FIG. 4 is a top view of FIG. 3.

FIGS. 3 and 4 show the sole-support plate 6 in its mounted state. The fillister-head screws 4 are thereby completely screwed in; each head 4*b* of each fillister-head screw 4 sitting thereby with the interpositioning of a seal ring 4*c*, preferably of rubber, in the head section 14 of the associated keyhole-like recess 12. The upper sides of the individual heads 4*b* of the fillister-head screws 4 terminate flush with the front cover side 15 of the sole-support plate 6. It is thus prevented that projecting screw parts hinder the ski boot in its movements. By using seal rings 4*c*, it is furthermore guaranteed that moisture, due to snow or ice, does not penetrate into the keyhole-like recesses 12. FIG. 2 shows furthermore how the two extensions 7 of the sole-support plate 6 grip around the base plate 2, with the embossments 2*a* constructed on the base plate below the individual fillister-head screws 4 guaranteeing a flat support of base plate 2 and sole-support plate 6.

The invention has been also described in connection with a metal band carrying another jaw member at its other end. If necessary, however, it is also possible to use a sole-support plate of the invention without a metal band.

Figure 6:
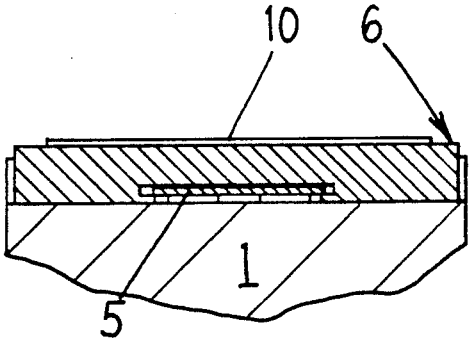
FIG. 6 is a cross-sectional view taken along the line VI—VI of FIG. 3.

If, however, a metal band exists as indicated in the present example, it is advantageous when the area of the sole-support plate 6, which area extends in direction toward the other jaw member, can be guided on the metal band 5 according to a further characteristic of the invention. The metal band 5 is in such a design used as a guide for the side surfaces of the sole-support plate 6, which side surfaces are constructed in cross section as a U-profile lying on its side. This arrangement is shown in FIG. 6, which is a cross section taken along the line VI—VI of FIG. 3. Even though the description does not differentiate between a front and a rear jaw member, it can be recognized from the further information that the exemplary embodiment relates to a sole-support plate 6 in connection with a jaw member 3 designed as a front jaw. A sole-support plate designed according to the invention and intended for the heel of the ski boot could be utilized with the same advantage. Only changes in dimensions and adjustments in the design would here be needed, which lie easily within the know-how of an average man skilled in the art.

The invention is not to be limited to the illustrated exemplary embodiment. It has already been mentioned that the front and the rear part of the entire ski binding can be exchanged with one another. It is furthermore conceivable to use inventively designed sole-support plates both in the front and also in the rear jaw area. It is furthermore conceivable to use, for sealing the space between the head section 14 of the individual recesses 12 and the heads 4*b* of the individual fillister-head screws 4, a seal ring 4*c* made of an easily deformable plastic in place of rubber.

Another modification would be to provide the base plate 2 of the jaw member 3 with a groove and to design the individual extensions 7 of the sole-support plate 6 as springs cooperating with the grooves. Such a design can be advantageous when the base plate is supported to rest with its underside completely on the upper side of the ski. Of course, this design has the disadvantage that the two extensions of the sole-support plate may be weakened. The capability of resistance of the entire sole-support plate with respect to its lateral support is with this, however, also reduced compared with the earlier described design. An advantage results, however, from the outer side surfaces of the extensions being designed as springs, which outer side surfaces are in alignment with the two side surfaces of the base plate of the jaw member.

The embodiments of the invention in which an exclusive property or privilege is claimed are defined as follows:

1. In a sole-support plate for ski bindings which is releasably fastened to a base plate of a ski-binding part, which base plate is adapted to be secured to the upper side of a ski by means of at least one fastening screw received in a bore in said base plate, at least one of said base plate and said sole-support plate having a groove on each of two laterally oppositely lying and vertically extending side surfaces, another of said base plate and said sole-support plate having lateral edges each being received in a respective groove on said at least one of said sole-support plate and said base plate and in a mounted state of said sole-support plate, said sole-support plate is thus held against lifting off from said base plate, said sole-support plate including at least one detent for preventing a movement of said sole-support plate relative to said base plate in a longitudinal direction of the ski, at least one recess also being provided on said sole-support plate, the improvement wherein said recess has a keyhole shape comprising a free straight section and a head section, wherein said recess is located on a region of said sole-support plate facing the ski-binding part, a longitudinal centerline of said recess being in alignment with a centerline of the fastening screw, wherein said detent is defined by said fastening screw itself, and wherein a width of said free straight section of each keyhole-shaped recess generally corresponds with an outside diameter of a shaft portion of said associated fastening screw, said head section of said recess defining a block engageable with said detent for preventing said movement of said sole-support plate relative to said base plate.

2. The sole-support plate according to claim 1, wherein, and referring to a longitudinal center axis of said base plate for the ski-binding part, two fastening screws are provided in a mirror-image symmetrical arrangement on opposite sides of said center axis, and wherein said sole-support plate has two keyhole-shaped recesses in a corresponding mirror-image symmetrical arrangement on opposite sides of said center axis.

3. The sole-support plate according to claim 1, wherein each fastening screw is a fillister-head screw having a conically tapering screwhead, wherein each head section of said recess, receives said fastening screw therein, is constructed as a bore having a clearance of generally 0.5 mm. greater than said head of said fillister-head screw associated with said recess, and wherein in the mounted state of said sole-support plate said head of said fillister-head screw terminates flush with a front cover side of said sole-support plate.

4. The sole-support plate according to claim 3, wherein a seal ring is inserted into said recess under said head of said fillister-head screw.

5. The sole-support plate according to claim 1, wherein said pair of laterally spaced extensions are provided on said sole-support plate and extend forwardly toward the ski binding part, each extension having a sidewall facing toward the other thereof, each sidewall having a said groove therein and extending coextensively therewith.

6. The sole-support plate according to claim 5, wherein each groove on said extensions has a height which is generally equal to, with added clearance, the thickness of said base plate.

7. The sole-support plate according to claim 1, in which in the area of the bore in said base plate, embossments are provided on an underside of said base plate and encircling said bore, wherein in the mounted state of said sole-support plate, undersides of said pair of extensions lie in a common plane, which plane is coplanar with a support plane defined by a downwardly facing surface on said embossment.

8. The sole-support plate according to claim 1, wherein a pair of ski binding parts are provided and are connected to each other by means of a metal band, wherein a bridge section is provided on an area of said sole-support plate projecting rearwardly of said ski-binding part, said bridge section including means for guiding said sole-support plate for longitudinal movement on said metal band.

9. The sole-support plate according to claim 8, wherein means for guiding said sole-support plate is a groove, lateral edges of which guidingly engage lateral edges of said metal band.

* * * * *